US009969049B2

(12) United States Patent
Pai et al.

(10) Patent No.: US 9,969,049 B2
(45) Date of Patent: May 15, 2018

(54) POLISHING LAYER OF POLISHING PAD AND METHOD OF FORMING THE SAME AND POLISHING METHOD

(71) Applicant: IV Technologies CO., Ltd., Taichung (TW)

(72) Inventors: Kun-Che Pai, Taichung (TW); Yu-Hao Pan, Taichung (TW)

(73) Assignee: IV Technologies CO., Ltd., Taichung (TW)

( * ) Notice: Subject to any disclaimer, the term of this patent is extended or adjusted under 35 U.S.C. 154(b) by 169 days.

(21) Appl. No.: 15/176,157

(22) Filed: Jun. 8, 2016

(65) Prior Publication Data

US 2016/0375546 A1 Dec. 29, 2016

(30) Foreign Application Priority Data

Jun. 29, 2015 (TW) ..... 104120966 A

(51) Int. Cl.
*B24B 37/26* (2012.01)
*B24B 37/24* (2012.01)

(52) U.S. Cl.
CPC ..... *B24B 37/26* (2013.01); *B24B 37/24* (2013.01)

(58) Field of Classification Search
CPC ..... B24B 37/24; B24B 37/26
See application file for complete search history.

(56) References Cited

U.S. PATENT DOCUMENTS 6,203,407 B1 * 3/2001 Robinson ..... B24B 37/26 451/41
6,206,759 B1 * 3/2001 Agarwal ..... B24B 37/22 451/307
6,354,913 B1 * 3/2002 Miyashita ..... B24B 37/0056 106/3
6,593,240 B1 * 7/2003 Page ..... B24B 37/042 216/88
6,848,977 B1 * 2/2005 Cook ..... B24B 37/26 204/212
2007/0238297 A1 * 10/2007 Chandrasekaran ..... B24B 37/26 438/690
2010/0003904 A1 * 1/2010 Duescher ..... B24B 37/14 451/259
2015/0147884 A1 * 5/2015 Kato ..... H01L 21/31053 438/693

(Continued)

FOREIGN PATENT DOCUMENTS

CN 103782371 5/2014
TW 200708606 3/2007

(Continued)

OTHER PUBLICATIONS

"Office Action of Taiwan Counterpart Application," dated Jul. 27, 2017, p. 1-p. 4.

*Primary Examiner* — Marc Carlson
(74) *Attorney, Agent, or Firm* — JCIPRNET

(57) ABSTRACT

A polishing layer of a polishing pad is provided. The polishing layer of the polishing pad includes a carrier layer and a plurality of embedded sections. The embedded sections embedded in the carrier layer are located in a polishing surface of the polishing layer, wherein in the polishing surface of the polishing layer, a groove is included in the carrier layer between every two adjacent embedded sections.

37 Claims, 6 Drawing Sheets

(56) References Cited

U.S. PATENT DOCUMENTS

| | | | | |
|---|---|---|---|---|
| 2015/0165586 | A1* | 6/2015 | Itoyama | B24B 37/14 451/41 |
| 2016/0107290 | A1* | 4/2016 | Bajaj | B33Y 80/00 451/527 |
| 2016/0114458 | A1* | 4/2016 | Bajaj | B24B 37/26 51/298 |
| 2016/0375552 | A1* | 12/2016 | Qian | B24D 18/00 51/298 |
| 2017/0312886 | A1* | 11/2017 | Mukai | B24D 3/04 |

FOREIGN PATENT DOCUMENTS

| | | | | |
|---|---|---|---|---|
| TW | 201350265 | | 12/2013 | |
| TW | 201429617 | | 8/2014 | |
| WO | WO 2009090897 | A1 * | 7/2009 | B24B 37/046 |
| WO | WO 2013039203 | A1 * | 3/2013 | B24B 37/26 |
| WO | WO 2013081665 | A2 * | 6/2013 | B24B 37/205 |
| WO | WO 2015194278 | A1 * | 12/2015 | B24B 37/24 |
| WO | WO 2016061585 | A1 * | 4/2016 | B24B 37/22 |

* cited by examiner

POLISHING LAYER OF POLISHING PAD AND METHOD OF FORMING THE SAME AND POLISHING METHOD

CROSS REFERENCE TO RELATED APPLICATION

This application claims the priority benefits of Taiwan application serial no. 104120966, filed on Jun. 29, 2015. The entirety of the above-mentioned patent application is hereby incorporated by reference herein and made a part of specification.

BACKGROUND OF THE INVENTION

1. Field of the Invention

The invention relates to a polishing layer of a polishing pad, a method of forming the same, and a polishing method, and particularly relates to a polishing layer enabling a polishing pad with combined properties, a method of forming the same, and a polishing method.

2. Description of Related Art

In the device manufacturing processes of the industries, the polishing process is currently a commonly used process to planarize the surface of the object to be polished. In the polishing process, the object and the polishing pads are moved with respect to each other, and the slurry is provided between the object surface and the polishing pad for polishing.

Based on the material properties of the polishing layer of the polishing pad used in the polishing process, the corresponding polishing properties may be offered. Some polishing processes may require two different polishing properties. Thus, such processes require two polishing pads having different material properties. However, such requirement increases the complexity in production and management, and influences the production efficiency.

Thus, a polishing pad with combined properties is required as an option for the industries.

SUMMARY OF THE INVENTION

The invention provides a polishing layer of a polishing pad, a method of forming the same, and a polishing method, which enable the polishing pad to have combined properties.

A method of forming a polishing layer of a polishing pad of the invention includes steps as follows. First of all, an embedded layer having a first surface and a second surface is provided. The first surface of the embedded layer has a plurality of recess sections along a direction. Then, a carrier layer is formed on the first surface of the embedded layer, and the carrier layer fills into the recess sections. Then, from the second surface of the embedded layer, a partial thickness of the embedded layer is removed until the carrier layer is exposed to form a plurality of embedded sections separately embedded in the carrier layer along the direction, so as to form a polishing layer. In addition, the embedded sections are located in a polishing surface of the polishing layer. Then, in the polishing surface of the polishing layer, a groove is formed in the carrier layer between every two adjacent embedded sections.

Another method of forming a polishing layer of a polishing pad of the invention includes steps as follows. First of all, a carrier layer is provided. In addition, a surface of the carrier layer has a plurality of recess sections along a direction. Then, a plurality of embedded sections are formed on the carrier layer. The embedded sections are embedded in the recess sections to form a polishing layer, and the embedded sections are located in a polishing surface of the polishing layer. Then, in the polishing surface of the polishing layer, a groove is formed in the carrier layer between every two adjacent embedded sections.

A polishing layer of a polishing pad of the invention includes a carrier layer and a plurality of embedded sections. The embedded sections are embedded in the carrier layer, and the embedded sections are located in a polishing surface of the polishing layer. In the polishing surface of the polishing layer, a groove is formed in the carrier layer between every two adjacent embedded sections.

A polishing method of the invention is suitable for polishing an object and includes steps as follows. First of all, a polishing pad is provided. The polishing pad includes the polishing layer. Then, a pressure is applied on the object to press the object onto the polishing pad. Then, a polishing process is performed by moving the object and the polishing pad with respect to each other.

A polishing layer of another polishing pad of the invention includes a carrier layer and a plurality of embedded sections. The embedded sections are embedded in the carrier layer, and the embedded sections are located in a polishing surface of the polishing layer. In addition, the polishing surface has a surface pattern, a cross-section of the surface pattern along a direction has a plurality of grooves located in the carrier layer. Also, the embedded sections and the grooves are alternately arranged.

Another polishing method of the invention is suitable for polishing an object and includes steps as follows. First of all, a polishing pad is provided. The polishing pad includes a polishing layer as aforementioned. Then, a pressure is applied on the object to press the object onto the polishing pad. Then, a polishing process is performed by moving the object and the polishing pad with respect to each other.

Based on above, the polishing layer of the invention is a polishing layer having a novel structure and includes the carrier layer and the embedded sections embedded in the carrier layer and located in the polishing surface. In addition, in the cross-section along a specific direction, the embedded sections and the grooves are alternately arranged. Besides, in the polishing layer of the invention, with at least one material property different between the carrier layer and the embedded sections, the polishing layer has the combined properties of the carrier layer and the embedded sections. Thereby, the polishing pad with such combined properties can be made for the industries as an option.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
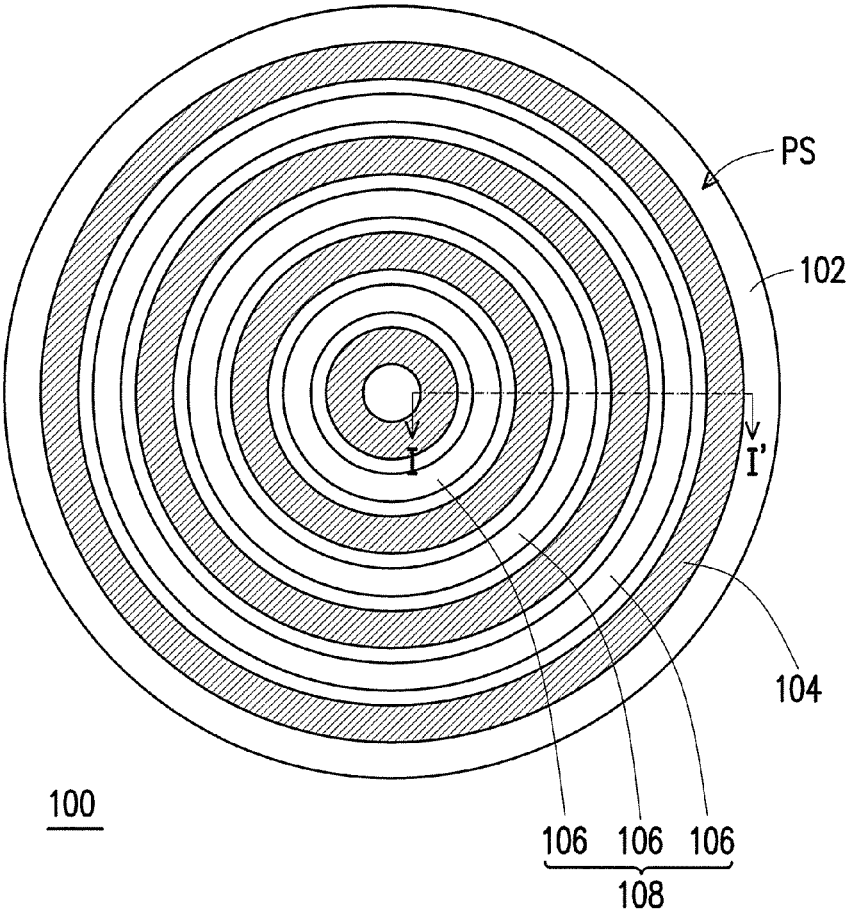
FIG. 1 is a schematic top view illustrating a polishing layer according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
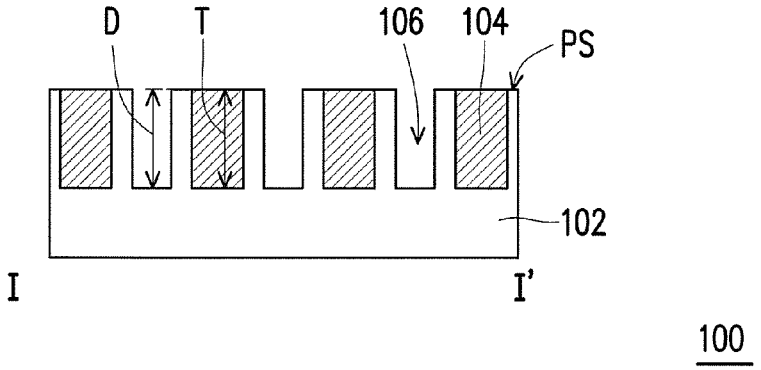
FIG. 2 is a schematic cross-sectional view taken along line I-I' in FIG. 1.

FIG. 1 is a schematic top view illustrating a polishing layer according to an embodiment of the invention. FIG. 2 is a schematic cross-sectional view taken along line I-I' in FIG. 1. Specifically, line I-I' in FIG. 1 is set along a radial direction. Namely, FIG. 2 is a schematic cross-sectional view along the radial direction.

Referring to FIGS. 1 and 2 together, a polishing layer 100 of this embodiment includes a carrier layer 102 and a plurality of embedded sections 104. The embedded sections 104 are embedded in the carrier layer 102, and are located in a polishing surface PS of the polishing layer 100. Specifically, the carrier layer 102 and the embedded sections 104 on the polishing surface PS are coplanar. In other words, when the polishing layer 100 is used to perform a polishing process to an object, the object may simultaneously contact the carrier layer 102 and the embedded sections 104 on the polishing surface PS.

Besides, the carrier layer 102 and the embedded sections 104 are both made of polymer materials, for example. The polymer materials are, for example, polyester, polyether, polyurethane, polycarbonate, polyacrylate, polybutadiene, or other polymer material synthesized with suitable thermosetting resins or thermoplastic resins. However, the invention is not limited to the aforesaid materials. Specifically, the polymer materials of the carrier layer 102 and the embedded sections 104 may be the same or different, but there is at least one material property different between the carrier layer 102 and the embedded sections 104. In an embodiment, components with different material properties may be manufactured with the same material by choosing to adjust manufacturing formulae. The above-mentioned material properties are properties such as water permeability, porosity, pore size, pore density, hydrophobicity/hydrophilicity, hardness, density, compressibility, modulus, elongation, wearing rate, or roughness, etc., for example. However, the invention is not limited to the aforesaid properties.

As shown in Table 1, in an embodiment of the invention, the polishing pad has 97% relative polishing rate and 44% relative water permeability. The embedded sections 104 of the polishing layer 100 of the polishing pad have a higher porosity, such that more slurry may be contained between a surface of the polishing layer 100 and the object, making the object have a higher polishing rate. In another aspect, the carrier layer 102 of the polishing layer 100 has a lower water permeability, so as to prevent delaminating between the polishing layer 100 and a base layer or an adhesive layer that is caused by water permeating to a back surface of the polishing layer 100. In this way, the polishing pad may have a longer lifespan. Thus, the polishing pad with the polishing layer 100 enables the object to have a preferable polishing rate and the polishing pad to have a preferable lifespan. In addition, the carrier layer 102, with the property of a lower water permeability, may include a lower porosity, a higher hydrophobicity, a higher density, or a combination thereof, for example. However, the invention is not limited thereto. Relatively, a polishing layer of a first conventional polishing pad only has a single material property of a higher porosity, more slurry may be contained between a surface of the polishing layer and the object, making the object have a higher polishing rate. However, such polishing layer also has a higher water permeability, which influences a lifespan of the first conventional polishing pad. As shown in Table 1, the first conventional polishing pad has 100% relative polishing rate and 100% relative water permeability. Another polishing layer of a second conventional polishing pad only has a single material property of a lower water permeability, such polishing layer enables the polishing pad to have a longer lifespan. However, the polishing layer of the second conventional polishing pad makes the polishing rate of the object lower, and thus influences the production efficiency. As shown in Table 1, the second conventional polishing pad has 31% relative water permeability but only 84% relative polishing rate.

TABLE 1

| | First conventional polishing pad | Second conventional polishing pad | Polishing pad of the invention |
|---|---|---|---|
| Relative polishing rate | 100% | 84% | 97% |
| Relative water permeability | 100% | 31% | 44% |

Note:
the relative water permeability and relative polishing rate are the water permeability and polishing rate with respect to the first conventional polishing pad.

Generally speaking, different material properties contribute to different performances of the polishing layers. Thus, by setting at least one material property different between the carrier layer 102 and the embedded sections 104, the polishing layer 100 is able to combine the properties originated from the carrier layer 102 and the embedded sections 104. Thereby, a polishing pad with such combined properties can be made for the industries as an option.

Then, referring FIG. 2 again, in the polishing surface PS of the polishing layer 100, a groove 106 is disposed in the carrier layer 102 between every two adjacent embedded sections 104. That is, in the cross-section along line I-I' in the radial direction, the polishing surface PS has a plurality of the grooves 106, and each of the grooves 106 is located between adjacent embedded sections 104. In other words, in the cross-section along line I-I' in the radial direction, the embedded sections 104 and the grooves 106 are alternately arranged.

Furthermore, as shown in FIG. 2, the grooves 106 and the embedded sections 104 are separate from each other. In an embodiment, each of the embedded sections 104 and the adjacent grooves 106 are separated by the carrier layer 102. More specifically, a bottom part and two sidewalls of each of the grooves 106 are surrounded by the carrier layer 102. In addition, a bottom part and two sidewalls of each of the embedded sections 104 are surrounded by the carrier layer 102. In FIG. 2, the grooves 106 are disposed in the carrier layer 102, and are symmetrical with respect to the adjacent embedded sections 104. However, the invention is not limited thereto. In an embodiment, alternatively, the grooves 106 may be disposed asymmetrically. In another embodiment, one of the sidewalls of the groove 106 may even be proximately adjacent to the embedded section 104. In other words, the bottom part and at least one sidewall of the groove 106 are surrounded by the carrier layer 102, and the bottom part and the at least one sidewall of the embedded section 104 are surrounded by the carrier layer 102. It should be noted in particular that, the water permeation path is mainly from the bottom parts of the grooves 106 to the back surface of the polishing layer 100. In the embodiment of the invention shown in Table 1, since the layer beneath the bottom parts of the grooves 106 is the carrier layer 102, and the carrier layer 102 has a lower water permeability, so as to prevent delaminating between the polishing layer 100 and a base layer or an adhesive layer that is caused by water permeating to a back surface of the polishing layer 100. In addition, since the embedded sections 104 located on the polishing surface have a higher porosity, more slurry may be contained between the polishing layer 100 and the object, so as to enable a higher polishing rate.

Besides, as shown in FIG. 2, in an embodiment, a thickness T of each of the embedded sections 104 is equal to a depth D of the adjacent grooves 106. In addition, the thickness T of the embedded sections 104 and the depth D of the grooves 106 are less than a thickness of the polishing layer 100. Nevertheless, the invention is not limited thereto. In other embodiments, the thickness T of each of the embedded sections 104 may also be greater or less than the depth D of the adjacent grooves 106.

From another perspective, referring to FIG. 1 again, the grooves 106 form a surface pattern 108 on the polishing surface PS. Specifically, in this embodiment, each of the grooves 106 has a circular shape, and the surface pattern 108 formed by the grooves 106 are concentrically distributed over the polishing surface PS. In addition, when the polishing layer 100 is used to perform a polishing process to an object, the grooves 106 mainly serve to transmit and distribute the slurry.

In the following, to further describe the polishing layer 100, a forming method of the polishing layer 100 is described with reference to FIGS. 3A to 3D. FIGS. 3A to 3D are schematic cross-sectional views taken along line I-I' of the polishing layer of FIG. 1 and illustrating a forming method according to an embodiment. Similarly, as described above, FIGS. 3A to 3D are cross-sectional views along the radial direction.

Figure 3A:
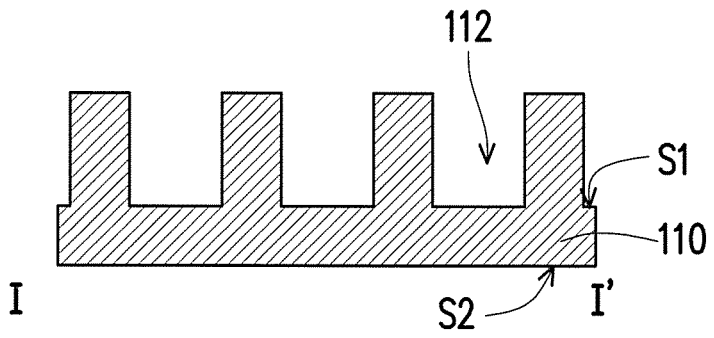
FIGS. 3A to 3D are schematic cross-sectional views taken along line I-I of the polishing layer of FIG. 1 and illustrating a forming method according to an embodiment.

First of all, referring to FIG. 3A, an embedded layer 110 is provided. The embedded layer 110 has a first surface S1 and a second surface S2. In addition, the first surface S1 has a plurality of recess sections 112 along the radial direction. More specifically, the recess sections 112 on the first surface S1 of the embedded layer 110 may be formed by performing a mechanical process, a chemical process, a laser removing process, an imprinting process, a molding process, or a combination thereof, for example. However, the invention is not limited to the aforesaid processes.

Figure 3B:
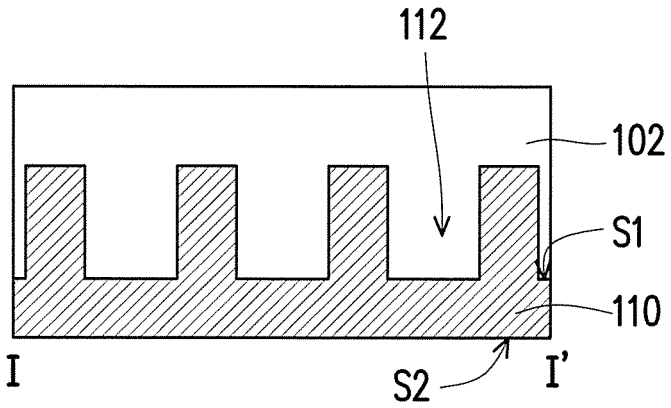

Then, referring to FIG. 3B, the carrier layer 102 is formed on the first surface S1 of the embedded layer 110. In addition, the carrier layer 102 fills into the recess sections 112. More specifically, the carrier layer 102 may be formed by performing an injecting process, a depositing process, a spraying process, a press molding process, an extruding process, or a combination thereof, for example. However, the invention is not limited to the aforesaid processes.

Figure 3C:
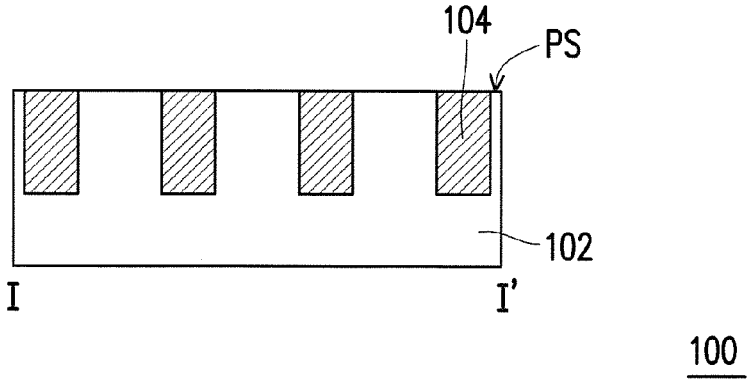

Then, referring to FIG. 3C, starting from the second surface S2 of the embedded layer 110, a partial thickness of the embedded layer 110 is removed until the carrier layer 102 is exposed. Thus, the embedded sections 104 separately embedded in the carrier layer 102 are formed in the radial direction, so as to form the polishing layer 100. In addition, the embedded sections 104 are located in the polishing surface PS of the polishing layer 100. More specifically, the partial thickness of the embedded layer 110 is removed from the second surface S2 by performing a mechanical cutting process, a chemical etching process, a laser removing process, an abrading process, or other suitable processes, for example. However, the invention is not limited to the aforesaid processes. Specially noted, FIG. 3C is a view illustrating a structure reversing FIG. 3B processed structure.

Figure 3D:
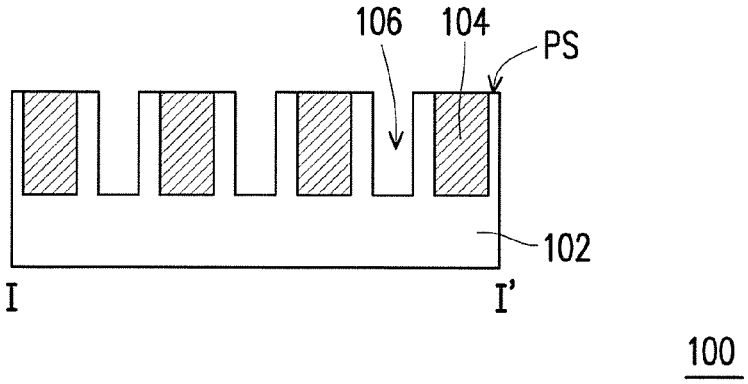

Then, referring to FIG. 3D, in the polishing surface PS of the polishing layer 100, the grooves 106 are formed in the carrier layer 102 between every two adjacent embedded sections 104. More specifically, the grooves 106 may be formed by performing a mechanical cutting process, a chemical etching process, a laser removing process, or other suitable processes, for example. However, the invention is not limited to the aforesaid processes. It should be noted that FIG. 3D is the same as FIG. 2. In the preceding description, the materials and properties of the carrier layer 102 and the embedded sections 104 of the polishing layer 100 and the configuration relations and effects of the carrier layer 102, the embedded sections 104, and the grooves 106 are already described in detail with reference to FIGS. 1 and 2. Thus, details in these respects will not be reiterated in the following.

In the following, to further describe the polishing layer 100, a forming method of the polishing layer 100 is described with reference to FIGS. 4A to 4D. FIGS. 4A to 4D are schematic cross-sectional views taken along line I-I' of the polishing layer of FIG. 1 and illustrating a forming method according to another embodiment. Similarly, as described above, FIGS. 4A to 4D are cross-sectional views along the radial direction.

Figure 4A:
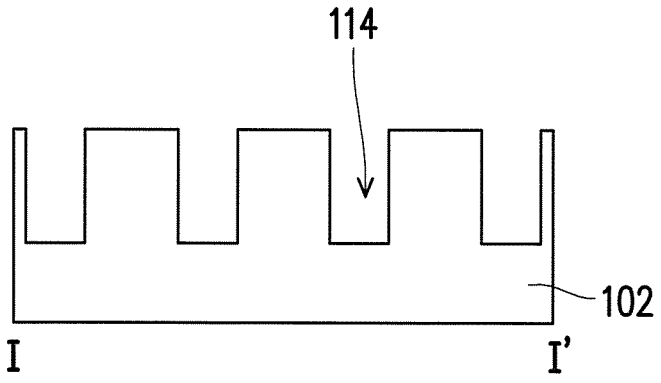
FIGS. 4A to 4D are schematic cross-sectional views taken along line I-P of the polishing layer of FIG. 1 and illustrating a forming method according to another embodiment.

First of all, referring to FIG. 4A, the carrier layer 102 is provided. In addition, a plurality of recess sections 114 are disposed on the surface of the carrier layer 102 along the radial direction. More specifically, the recess sections 114 on the surface of the carrier layer 102 may be formed by performing a mechanical process, a chemical process, a laser removing process, an imprinting process, a molding process, or a combination thereof, for example. However, the invention is not limited to the aforesaid processes.

Figure 4B:
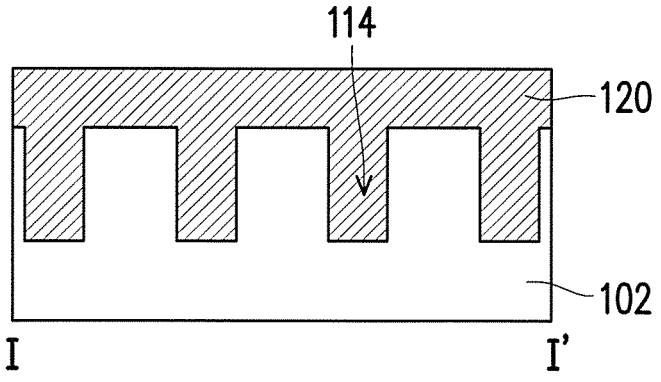

Then, referring to FIG. 4B, an embedded layer 120 is formed on the carrier layer 102, and the embedded layer 120 fills into the recess sections 114. More specifically, the embedded layer 120 may be formed by performing an injecting process, a depositing process, a spraying process, a press molding process, an extruding process, or a combination thereof, for example. However, the invention is not limited to the aforesaid processes.

Figure 4C:
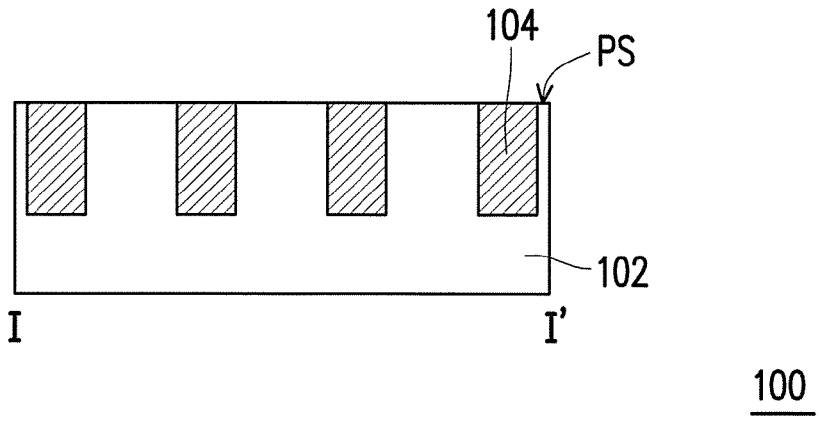

Then, referring to FIG. 4C, the thickness of the embedded layer 120 is partially removed until the carrier layer 102 is exposed. In addition, the embedded sections 104 embedded in the recess sections 114 are formed on the carrier layer 102, so as to form the polishing layer 100. The embedded sections 104 are located on the polishing surface PS of the polishing layer 100. Specifically, the thickness of the embedded layer 120 is partially removed by performing a mechanical cutting process, a chemical etching process, a laser removing process, or other suitable processes, for example. However, the invention is not limited to the above processes.

Figure 4D:
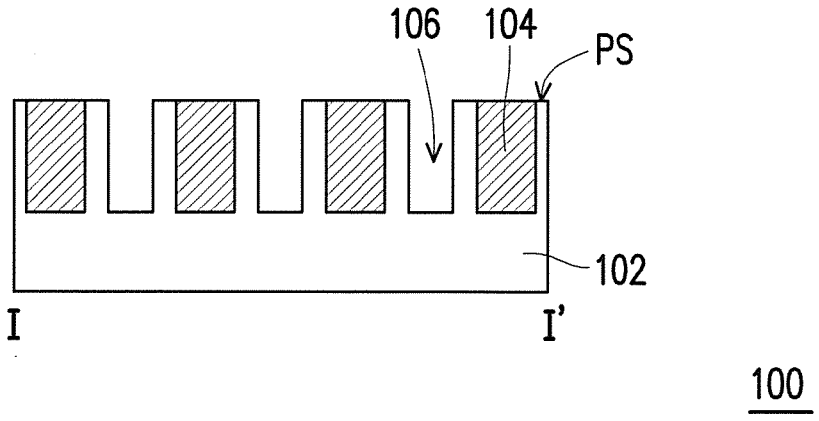

Then, referring to FIG. 4D, in the polishing surface PS of the polishing layer 100, the grooves 106 are formed in the carrier layer 102 between every two adjacent embedded sections 104. More specifically, the grooves 106 may be formed by performing a mechanical cutting process, a chemical etching process, a laser removing process, or other suitable processes, for example. However, the invention is not limited to the aforesaid processes. It should be noted that FIG. 4D is the same as FIG. 2. In the preceding description, the materials and properties of the carrier layer 102 and the embedded sections 104 of the polishing layer 100 and the configuration relations and effects of the carrier layer 102, the embedded sections 104, and the grooves 106 are already described in detail with reference to FIGS. 1 and 2. Thus, details in these respects will not be reiterated in the following.

Also, in the embodiment of FIG. 1, the grooves 106 are arranged as concentric circles. However, the invention is not limited thereto. In other embodiments, the grooves may be arranged to be non-concentrically circular, elliptical, polygonal annular, spiral annular, irregular annular, linearly parallel, linearly radiating, arc-like radiating, spiral, spot-like, X-Y grid, polygonal grid, irregular, or a combination thereof. However, the invention is not limited to the aforesaid arrangements. In the following, with reference to FIG. 5, an embodiment where the grooves arranged in X-Y grid is described in detail.

Figure 5:
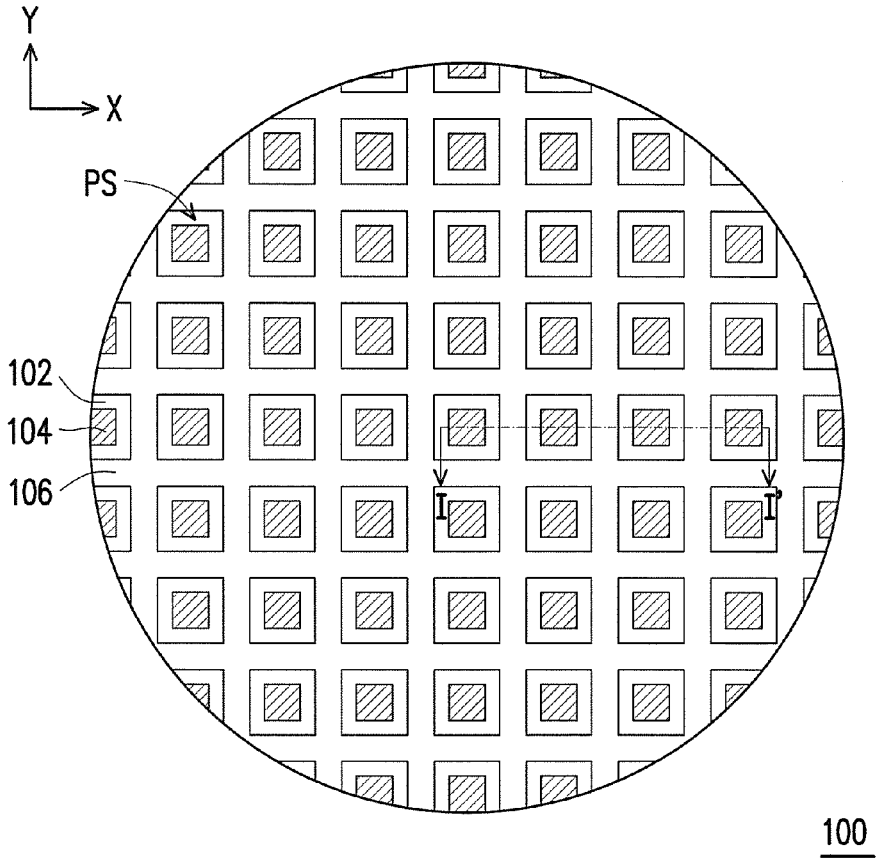
FIG. 5 is a schematic top view illustrating a polishing layer according to another embodiment of the invention.

FIG. 5 is a schematic top view illustrating a polishing layer according to another embodiment of the invention. A cross-section along line I-I' in FIG. 5 may be referred to FIG. 2. Specifically, the embodiment shown in FIG. 5 is similar to the embodiment of FIG. 1. Thus, like or similar components are referred to with like or similar symbols, and the same features of the same components will not be reiterated in the following. The embodiment of FIG. 5 differs from the embodiment of FIG. 1 in that, line I-I' in FIG. 5 is set along a direction parallel to X-axis, while line I-I' in FIG. 1 is set along the radial direction. In other words, the cross-section along line I-I' in FIG. 5 is a cross-section along the direction parallel to X-axis, while the cross-section along line I-I in FIG. 1 is a cross-section along the radial direction. In another perspective, the polishing layer 100 of FIG. 5 and the polishing layer 100 of FIG. 1 have the same cross-sectional structure shown in FIG. 2.

More specifically, if a cross-section is taken along a direction parallel to Y-axis in the polishing layer 100 of FIG. 5, the cross-section also has the same cross-sectional structure as shown in FIG. 2. In other words, in FIG. 5, upper, lower, left, and right sides of the embedded section 104 are surrounded by the grooves 106, while in FIG. 1, two sides of the embedded section 104 in an inner diameter direction and an outer diameter direction are surrounded by the grooves 106. Thus, in the polishing layer of the invention, no matter how the embedded sections are arranged in the polishing surface, a cross-sectional structure where the embedded sections and the grooves are alternatively arranged and the grooves make the adjacent embedded sections separate from each other in a cross-section along a specific direction may be presented. Specifically, the specific direction may be a direction parallel to X-axis, a direction parallel to Y-axis, a direction having an included angle with respect to X-axis, a radial direction, a circumferential direction, or a combination thereof. However, the invention is not limited thereto.

Also, the embedded sections and the grooves in the polishing layer of the invention are not limited to those shown in FIGS. 1 and 5. In addition, based on different shapes of arrangements and sizes of the embedded sections and the grooves, the cross-sectional structure as illustrated in FIG. 2 may be along a different specific direction. For example, under the circumstance that the embedded sections and the grooves are in a radiating arrangement, the cross-section of the specific direction chosen is a cross-section along a circumferential direction with the same radius.

In addition, based on the contents in FIGS. 1, 2, 3A to 3D, and 4A to 4D, people having ordinary skills in the art should be able to understand the forming method of the polishing layer 100 in FIG. 5. Thus, details in this respect will not be reiterated in the following.

Figure 6:
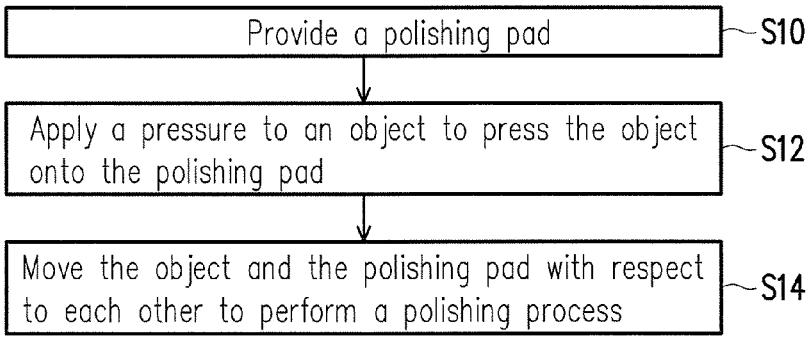
FIG. 6 is a flowchart illustrating a polishing method according to an embodiment of the invention.

FIG. 6 is a flowchart illustrating a polishing method according to an embodiment of the invention. The polishing method is suitable to polish an object. Specifically, the polishing method may be used in a polishing process for manufacturing an industrial component, such as a component used in the electronic industries, including semiconductor devices, integrated circuits, micro-electromechanical devices, energy conversion devices, communication devices, optical devices, disks for storage, and displays etc., and objects for manufacturing these devices include semiconductor wafers, Group III-V wafers, carriers of storage devices, ceramic substrates, polymer substrates, and glass substrates, etc. However, the invention is not limited thereto.

Referring to FIG. 6, first of all, a polishing pad is provided at Step S10. Specifically, in this embodiment, the polishing pad includes the polishing layer 100 as above-described and shown in FIG. 1 or FIG. 5, for example. Besides, in this embodiment, the polishing pad may include a base layer, an adhesive layer, or a combination thereof below the polishing layer 100.

Then, Step S12 is performed to apply a pressure to an object. Accordingly, the object is pressed onto the polishing pad and contacts the polishing pad. Specifically, the object contacts the polishing surface PS in the polishing layer 100. More specifically, the object simultaneously contacts the carrier layer 102 and the embedded sections 104 on the polishing layer PS. Besides, the process of applying the pressure to the object may be performed by using a carrier capable of holding the object.

Then, Step S14 is performed to move the object and the polishing pad with respect to each other, so as to perform a polishing process to the object by using the polishing pad for planarization. Specifically, the object and the polishing pad are moved with respect to each other by rotating a platen to drive the polishing pad fixed on the platen a rotational movement, for example.

By combining different material properties, the lower water permeability of the carrier layer and the higher porosity of the embedded sections, the polishing layer of the above embodiments of the invention enable the polishing pad formed accordingly to have such combined properties of the lower water permeability and the higher polishing rate. However, the invention is not limited thereto. For some polishing processes, the carrier layer and the embedded sections may have other different material properties. For example, the embedded sections may have a greater hardness or lower compressibility contributing to a better planarization performance for the polished object, while the carrier layer may have a lower hardness or greater compressibility contributing to a lower defective rate for the object. In this way, the polishing pad formed accordingly has such combined properties of the better planarization performance and the lower defective rate. In other words, depending on requirements of various polishing processes, different material properties desired can be selected for the carrier layer and the embedded sections of the polishing layer. Accordingly, the polishing pad formed with the polishing layer as the novel structure provided in the invention is enabled to have such combined material properties.

In view of the foregoing, the polishing layer of the invention is a polishing layer having a novel structure and includes the carrier layer and the embedded sections embedded in the carrier layer and located in the polishing surface. In addition, in the cross-section along a specific direction, the embedded sections and the grooves are alternately arranged. Besides, in the polishing layer of the invention, with at least one material property different between the carrier layer and the embedded sections, the polishing layer has the combined properties of the carrier layer and the embedded sections, thereby the polishing pad with such combined properties can be made for the industries as an option.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method of forming a polishing layer of a polishing pad, comprising:

providing an embedded layer having a first surface and a second surface, wherein the first surface of the embedded layer has a plurality of recess sections along a direction;

forming a carrier layer on the first surface of the embedded layer, the carrier layer filling into the recess sections;

from the second surface of the embedded layer, removing a partial thickness of the embedded layer until the carrier layer is exposed to form a plurality of embedded sections separately embedded in the carrier layer along the direction, so as to form a polishing layer, wherein the embedded sections are located in a polishing surface of the polishing layer; and in the polishing surface of the polishing layer, forming a groove in the carrier layer between every two adjacent embedded sections.

2. The method of forming the polishing layer of the polishing pad as claimed in claim 1, wherein the recess sections of the embedded layer are formed by performing a mechanical process, a chemical process, an imprinting process, a molding process, or a combination thereof.

3. The method of forming the polishing layer of the polishing pad as claimed in claim 1, wherein the carrier layer and the embedded sections differ in at least one material property.

4. The method of forming the polishing layer of the polishing pad as claimed in claim 1, wherein the carrier layer and the embedded sections on the polishing surface are coplanar.

5. The method of forming the polishing layer of the polishing pad as claimed in claim 1, wherein a bottom part and at least one sidewall of each of the grooves are surrounded by the carrier layer.

6. The method of forming the polishing layer of the polishing pad as claimed in claim 1, wherein a bottom part and at least one sidewall of each of the embedded sections are surrounded by the carrier layer.

7. The method of forming the polishing layer of the polishing pad as claimed in claim 1, wherein each of the grooves and the adjacent embedded sections are separated by the carrier layer.

8. The method of forming the polishing layer of the polishing pad as claimed in claim 1, wherein each of the grooves and the adjacent embedded sections are symmetrically or asymmetrically arranged in the carrier layer.

9. The method of forming the polishing layer of the polishing pad as claimed in claim 1, wherein a thickness of each of the embedded sections is greater than, equal to or less than a depth of the adjacent grooves.

10. A method of forming a polishing layer of a polishing pad, comprising:

providing a carrier layer, wherein a surface of the carrier layer has a plurality of recess sections along a direction;

forming a plurality of embedded sections on the carrier layer, wherein the embedded sections are embedded in the recess sections to form a polishing layer, and the embedded sections are located in a polishing surface of the polishing layer, and in the polishing surface of the polishing layer, forming a groove in the carrier layer between every two adjacent embedded sections.

11. The method of forming the polishing layer of the polishing pad as claimed in claim 10, wherein the recess sections of the carrier layer are formed by performing a mechanical process, a chemical process, an imprinting process, a molding process, or a combination thereof.

12. The method of forming the polishing layer of the polishing pad as claimed in claim 10, wherein the steps of forming the embedded sections comprise:

forming an embedded layer on the carrier layer, wherein the embedded layer fills into the recess sections; and removing a partial thickness of the embedded layer until the carrier layer is exposed.

13. The method of forming the polishing layer of the polishing pad as claimed in claim 10, wherein the carrier layer and the embedded sections differ in at least one material property.

14. The method of forming the polishing layer of the polishing pad as claimed in claim 10, wherein the carrier layer and the embedded sections on the polishing surface are coplanar.

15. The method of forming the polishing layer of the polishing pad as claimed in claim 10, wherein a bottom part and at least one sidewall of each of the grooves are surrounded by the carrier layer.

16. The method of forming the polishing layer of the polishing pad as claimed in claim 10, wherein a bottom part and at least one sidewall of each of the embedded sections are surrounded by the carrier layer.

17. The method of forming the polishing layer of the polishing pad as claimed in claim 10, wherein each of the grooves and the adjacent embedded sections are separated by the carrier layer.

18. The method of forming the polishing layer of the polishing pad as claimed in claim 10, wherein each of the grooves and the adjacent embedded sections are symmetrically or asymmetrically arranged in the carrier layer.

19. The method of forming the polishing layer of the polishing pad as claimed in claim 10, wherein a thickness of each of the embedded sections is greater than, equal to or less than a depth of the adjacent grooves.

20. A polishing layer of a polishing pad, comprising:

a carrier layer comprising a polishing surface; and a plurality of embedded sections, wherein the embedded sections are each embedded within a cavity in the carrier layer, and the embedded sections are coincident with the polishing surface, wherein at least one groove is formed in the carrier layer between every two adjacent embedded sections forming at least one gap in the polishing surface.

21. The polishing layer of the polishing pad as claimed in claim 20, wherein the carrier layer and the embedded sections differ in at least one material property.

22. The polishing layer of the polishing pad as claimed in claim 20, wherein the polishing surface of the carrier layer and the embedded sections are coplanar.

23. The polishing layer of the polishing pad as claimed in claim 20, wherein a bottom part and at least one sidewall of each of the grooves are surrounded by the carrier layer.

24. The polishing layer of the polishing pad as claimed in claim 20, wherein a bottom part and at least one sidewall of each of the embedded sections are surrounded by the carrier layer.

25. The polishing layer of the polishing pad as claimed in claim 20, wherein each of the grooves and the adjacent embedded sections are separated by the carrier layer.

26. The polishing layer of the polishing pad as claimed in claim 20, wherein each of the grooves and the adjacent embedded sections are symmetrically or asymmetrically arranged in the carrier layer.

27. The polishing layer of the polishing pad as claimed in claim 20, wherein a thickness of each of the embedded sections is greater than, equal to or less than a depth of the adjacent grooves.

28. A polishing layer of a polishing pad, comprising:

a carrier layer comprising a polishing surface; and a plurality of embedded sections, wherein the embedded sections are each embedded within a cavity in the carrier layer, and the embedded sections are coincident with the polishing surface, wherein the polishing surface has a surface pattern defined by a plurality of grooves formed in the carrier layer, wherein the embedded sections and the grooves are alternately arranged.

29. The polishing layer of the polishing pad as claimed in claim 28, wherein the carrier layer and the embedded sections differ in at least one material property.

30. The polishing layer of the polishing pad as claimed in claim 28, wherein the polishing surface of the carrier layer and the embedded sections are coplanar.

31. The polishing layer of the polishing pad as claimed in claim 28, wherein a bottom part and at least one sidewall of each of the grooves are surrounded by the carrier layer.

32. The polishing layer of the polishing pad as claimed in claim 28, wherein a bottom part and at least one sidewall of each of the embedded sections are surrounded by the carrier layer.

33. The polishing layer of the polishing pad as claimed in claim 28, wherein each of the grooves and the adjacent embedded sections are separated by the carrier layer.

34. The polishing layer of the polishing pad as claimed in claim 28, wherein each of the grooves and the adjacent embedded sections are symmetrically or asymmetrically arranged in the carrier layer.

35. The polishing layer of the polishing pad as claimed in claim 28, wherein a thickness of each of the embedded sections is greater than, equal to or less than a depth of the adjacent grooves.

36. A polishing method suitable for polishing an object, comprising:

providing a polishing pad, comprising a polishing layer, wherein the polishing layer comprising:

a carrier layer comprising a polishing surface; and a plurality of embedded sections, wherein the embedded sections are each embedded within a cavity in the carrier layer, and the embedded sections are coincident with the polishing surface, wherein at least one groove is formed in the carrier layer between every two adjacent embedded sections forming at least one gap in the polishing surface;

applying a pressure on the object to press the object onto the polishing pad; and performing a polishing process by moving the object and the polishing pad with respect to each other.

37. A polishing method suitable for polishing an object, comprising:

providing a polishing pad, comprising a polishing layer, wherein the polishing layer comprising:

a carrier layer comprising a polishing surface; and a plurality of embedded sections, wherein the embedded sections are each embedded within a cavity in the carrier layer, and the embedded sections are coincident with the polishing surface, wherein the polishing surface has a surface pattern defined by a plurality of grooves formed in the carrier layer, wherein the embedded sections and the grooves are alternately arranged;

applying a pressure on the object to press the object onto the polishing pad; and performing a polishing process by moving the object and the polishing pad with respect to each other.

* * * * *